United States Patent [19]

Moschovis et al.

[11] 4,058,470

[45] Nov. 15, 1977

[54] LIQUID DEVELOPER COMPOSITION FOR LITHOGRAPHIC MASTERS

[75] Inventors: Elia P. Moschovis; John L. Gilson, both of Morton Grove, Ill.

[73] Assignee: A. B. Dick Company, Niles, Ill.

[21] Appl. No.: 625,753

[22] Filed: Oct. 24, 1975

[51] Int. Cl.[2] ..... G03G 9/12

[52] U.S. Cl. ..... 252/62.1 L; 96/1 LY; 101/451; 106/2; 427/17

[58] Field of Search ..... 252/62.1 L; 96/1 LY; 101/451; 427/17; 106/2

[56] References Cited

U.S. PATENT DOCUMENTS

| | | | |
|---|---|---|---|
| 2,890,174 | 6/1959 | Mayer | 252/62.1 L |
| 3,234,873 | 2/1966 | Miller | 101/451 |
| 3,417,019 | 12/1968 | Beyer | 252/62.1 L |
| 3,573,041 | 3/1971 | Van Engeland et al. | 101/451 |
| 3,617,266 | 11/1971 | Williams et al. | 101/451 |
| 3,714,048 | 1/1973 | Adachi et al. | 252/62.1 L |
| 3,714,891 | 2/1973 | Van Dusen et al. | 101/451 |
| 3,793,234 | 2/1974 | Ormsbee | 252/62.1 |
| 3,821,931 | 7/1974 | Yamaji et al. | 101/451 |
| 3,908,547 | 9/1975 | Rochlitz | 101/451 |
| 3,915,874 | 10/1975 | Machida | 252/62.1 L |
| 3,939,087 | 2/1976 | Vijayendran | 252/62.1 L |

*Primary Examiner*—Mayer Weinblatt
*Assistant Examiner*—John D. Smith
*Attorney, Agent, or Firm*—McDougall, Hersh & Scott

[57] ABSTRACT

A liquid developer for treatment to convert a latent electrostatic image to an ink receptive, water repellent, oleophilic image for use in the production of multiple copies by lithographic technique in which, in addition to the toner particles and organic solvent, the developer contains a polyvinyl acetate as a binder and a hydrophobic colloidal silica in the ratio of 1 part silica to 1.5 to 4 parts binder whereby the oleophilic properties of the image are markedly improved.

9 Claims, No Drawings

LIQUID DEVELOPER COMPOSITION FOR LITHOGRAPHIC MASTERS

This invention relates to the production of multiple copies from an offset master imaged by electrophotographic technique and it relates more particularly to a liquid developer used in the development of the formed latent electrostatic image to produce an ink receptive, water repellent, oleophilic imaged portion with an ink repellent, water receptive, hydrophilic background whereby multiple copies can be produced by lithographic technique.

Masters suitable for imaging by electrophotographic technique are fabricated of a base sheet of metal, plastic, paper and the like flexible support, having a coating of a photoconductive material such as a photoconductive zinc oxide bonded with a resinous binder for the development of a latent electrostatic image by the well known electrostatic technique.

In this process, the photoconductive coating is given an overall electrostatic charge, while being protected from light. Thereafter, the charged surface is exposed to a light pattern of the subject to be reproduced. The electrostatic charge on the coating is dissipated in the areas struck by light and retained in the unexposed areas thereby to define a latent electrostatic reproduction of the optical image. This latent electrostatic image can then be developed by a developer composition containing toner particles which are attracted to the electrostatic image in a "positive" toning process, or to the background area in a "negative" toning process.

In the process known as the "A. B. Dick Videograph Process", described in U.S. Pat. No. 2,996,573, and U.S. Pat. No. 3,075,859, a latent electrostatic image is inscribed by conductive elements extending through the face of a cathode ray tube for deposition directly onto a dielectric coating on the surface of a base sheet or other highly electrically conductive material. The formed latent electrostatic image is developed by a developer, as previously described.

When such imaged surfaces are developed with a developer formulated to contain an ink receptive, water repellent, oleophilic toner, the image that is developed becomes ink receptive, water repellent and oleophilic. However, by reason of the presence of an organic binder in the coating, the background or non-imaged areas are generally not sufficiently ink repellent, water receptive, and hydrophilic to provide the desired balance for use as an imaged lithographic master from which multiple copies of good quality can be produced by lithographic technique.

It becomes necessary to treat the surface, after imaging, with a conversion solution to convert the non-imaged surfaces to a more highly water receptive, ink repellent, hydrophilic surface, as described in U.S. Pat. No. 3,661,598.

It has been found that lithographic masters, imaged with current liquid developers and converted in the usual manner with conventional conversion solutions, are slow to take ink in the copy process, with the result that initial copies are of poor copy quality and that image density of the copy is weak. These characteristics are particularly noticeable when the imaged master is subjected to multiple conversion treatments or to over-conversion.

Another characteristic that has been observed with many liquid developers is the tendency toward sedimentation upon aging, with the result that changes occur in the compositions and the copies that are produced from masters imaged therewith.

It is an object of this invention to provide an improved developer composition for use in the preparation of electrophotographic masters in the production of multiple copies by lithographic technique, in which the rheology of the developer composition is improved to minimize sedimentation, in which the oleophilic characteristics of the formed image are enhanced to provide instant inking of the image and good image density throughout the copy process, even after multiple conversions or over-conversion in the preparation of the imaged master.

In U.S. Pat. No. 3,793,234, description is made of a liquid developer formulated of an aliphatic organic solvent, a rosin or rosin derivative, electrically attractive pigment particles of carbon black and a nigrosine dye, a dispersant in the form of a methylmethacrylate polymer which operates to retain the pigment particles dispersed in the liquid carrier, and a binder selected of polyvinyl toluene, polyvinyl acetate, vinyl acetate copolymer, polyvinyl chloride, polystyrene, butadiene-styrene copolymer, and alkyd resin.

It has been found, in accordance with the practice of this invention, that a liquid developer composition of the type described in the aforementioned patent can be greatly improved from the standpoint of sedimentation, stability and oleophilicity by formulation of the developer composition to make use of a polyvinyl acetate as a binder and a hydrophobic colloidal silica as a dispersant, with the ratio of polyvinyl acetate and colloidal silica being maintained within a ratio of 1 part by weight colloidal silica to 1.5 to 4 parts by weight of polyvinyl acetate and preferably 1 part by weight of colloidal silica to 2 to 3 parts by weight of the polyvinyl acetate resin, with the polyvinyl acetate being present in the developer composition in an amount within the range of 0.02 to 1.0% by weight and preferably 0.03 to 0.07% by weight of the developer composition.

The polyvinyl acetate can be a bulk polymer of the type marketed by Monsanto Chemical Company under the trade name Gelva V-1.5 or it can be one that is formed by emulsion polymerization in aqueous medium, such as marketed by Air Products and Chemicals, Inc. under the trade name Vinac RP-251. Vinyl acetate polymers formed by dispersion polymerization are also suitable for use as the binder component in the developer compositions embodying the features of this invention.

Representative of the hydrophobic colloidal silica which can be used in the practice of this invention is QUSO - WR 50, marketed by Philadelphia Quartz Company. The above is merely representative of a hydrophobic colloidal silica that can be used since other hydrophobic colloidal silicas well known to the industry can be employed as the colloidal silica component in the practice of this invention.

The invention will now be illustrated by the following specific example which is given by way of illustration, and not by way of limitation, of a best mode for placing the invention into practice.

EXAMPLE 1

An electrophotographic offset master of the type described in U.S. Pat. No. 2,987,395, or U.S. Pat. No. 3,001,872, is charged by corona discharge to provide an overall electrostatic charge over the photoconductive zinc oxide - resinous binder coating on a paper base sheet, as described in the aforementioned patents.

The charged surface is exposed to a light pattern corresponding to the negative of the image to be reproduced, whereby the electrostatic charge is dissipated in the areas struck by light and retained in the areas which have not been struck by light. This leaves a latent electrostatic image on the surface of the master corresponding to the copy to be reproduced.

The surface of the master containing the latent electrostatic image is then developed by wetting with a developer composition embodying the features of this invention.

Developer composition:

(a) Grind composition:

| % by weight | Ingredient |
|---|---|
| 5.70 | Carbon Black (Raven 1170 of Columbia Carbon) |
| 2.75 | Spirit Nigrosine SSB (Allied Chemical) |
| 0.83 | Alkali Blue R (American Cyanamid) |
| 53.5 | Hercolyn D (Hercules Chemical Co.) |
| 12.6 | Fuel oil additive No. 2 (E. I. du Pont) |
| 7.0 | Hydrophobic colloidal silica (QUSO WR-50 - Philadelphia Quarts) |
| 17.5 | Polyvinyl acetate (Gelva V-1.5- Monsanto Chemical Company) |

The materials are thoroughly mixed and then milled on a water cooled three roll mill by taking three passes at 350 psi and four passes at 400 psi. Instead of milling on a roller mill, the grind composition can be processed in a ball mill with steel or ceramic balls as the grinding medium.

b. Toner Concentration:

| % by weight | Ingredient |
|---|---|
| 42.8 | Grind Composition (a) |
| 7.0 | Paraffin Oil No. 11 (Standard Oil of Indiana) |
| 0.05 | Pliolite VTL (Goodyear Rubber Co.) |
| 0.35 | Aromatic 100 (Exxon Co., U.S.A.) |
| 49.80 | Isopar G (Exxon Co., U.S.A.) |

The above were combined and dispersed for five minutes on a Premier Dispersator, Type DD, marketed by Premier Mill Corporation of Geneva, New York. Other devices for intimate dispersion can be used, such as an attrition mill, high speed mixer, and the like.

c. Developer Composition:

For use in the development of the latent electrostatic image, the concentrate (b) is diluted with Isopar G in the ratio of 6.5 ml of concentrate (b) per liter of Isopar G.

After the developed plate has been dried and prior to mounting onto the offset press for the production of multiple copies by lithographic technique, the imaged surface of the plate is treated with a conversion solution such as described in U.S. Pat. No. 3,661,598, or as represented by the following conversion solution composition.

8.0% by weight ammonium dihydrogen phosphate
2.0% by weight potassium ferrocyanide
1.0% by weight potassium sulfite
0.1% by weight disodium ethylene diamine tetraacetate
88.9% by weight deionized water The pH of the solution is adjusted to 4.5 at 25° C, with phosphoric acid.

The resulting masters were run on an offset duplicator after single and multiple treatment with the conversion solution. The resulting copy was of good quality. A good dense image was produced from practically the first copy to the end of the run (500 copies), indicating rapid ink pick up and a proper balance between the oleophilic image and the hydrophilic background.

The Hercolyn D is a hydrogenated methyl ester of rosin which is marketed by Hercules Chemical Company. A wide variety of rosins and rosin derivatives can be used to replace all or part of the Hercolyn D in Example 1.

Included are tall oils of rosin as well as their ester and hydrogenated ester derivative. This material serves, at least in part, to disperse the pigment or toner particles in the developer composition. In addition it serves as a charge directing agent and partial fixing agent by forming a thin film which anchors the pigment particles to the surface of the photoconductive coating. The amount of rosin or rosin derivative present in the concentrate may range from 10–40% by weight and preferably 28–38% by weight. In the final liquid developer, the concentration of rosin or derivative will range between 0.02 to 0.08% by weight of the developer composition.

Fuel oil additive No. 2 is a mixture of 50% by weight methacrylate polymer and 50% by weight kerosene. This material acts as a dispersant or restrainer in order to insure that the toner particles remain in suspension in the concentrate and in the developer composition. As a result, the toner will not tend to settle out, thereby to avoid tailing and agglomeration. Instead of fuel oil additive, use may be made of metal fatty acid soaps such as calcium stearate and the like. When employed, the dispersant or restrainer is employed in an amount within the range of 0.1 to 10% by weight and preferably 3 to 7% by weight of the concentrate and 0.0002 to 0.02% by weight in the developer composition.

The paraffin oil No. 11 represents a paraffinic oil which operates to produce blacker copy and serves also to minimize settling of the pigment particles in the toner compositions. Instead of a paraffinic oil, use can be made of a naphthenic mineral oil. When present, the oil component is generally employed in an amount up to 10% by weight of the toner concentrate and up to about 0.02% by weight of the developer composition.

Alkali Blue R is a powder marketed by American Cyanamid Company. The material is frequently used as a toning agent to improve the color of the image. Other toning agents, preferably a flushed blue color or an alkali blue, can be used instead of Alkali Blue R in Example 1 since they have been found to aid in providing a cleaner background and a denser image.

Isopar G is an aliphatic solvent marketed by the Exxon Co., U.S.A. having a flash point of 104° F and a KB value of about 27. It is desirable to make use of an aliphatic solvent in formulating the toner concentrate and the developer composition in order to maintain the pigment or toner particles in dispersion. Aliphatic solvents which are used for this purpose should have a high volume resistivity in excess of $10^{10}$ ohms-cm, so as to avoid dissipation of the charge from the electrostatic image. Such aliphatic solvent serves also to avoid attack on the binder in the photoconductive coating.

Pliolite VTL is a modified polyvinyl toluene resin, marketed by Goodyear Rubber Company. Various binders, such as polyvinyl acetate, polyvinyl acetate copolymers, polyvinyl chloride, polystyrene, styrene-butadiene copolymers, alkyd and modified alkyd resins may be used instead of Pliolite VTL in Example 1. The binder component may be employed in the developer composition in an amount within the range of 0.00001 to 0.05% by weight.

Further improvement in the oleophilic character of the imaged portion, with corresponding improvement in image density and life of the imaged plate, independent of the number of conversions or over-conversion, is obtained by addition to the liquid developer composition of an amine derivative, as described in our copending application filed concurrently herewith and entitled "Liquid Developer for Electrophotographic Offset Masters". As the amine derivative added to the developer composition of this invention, as represented in Example 1, use can be made of an aliphatic amine having 3 to 18 carbon atoms in the aliphatic group, a fatty acid amine, an aromatic amine and/or a heterocyclic amine. Suitable amines may be illustrated by the following:

1. a fatty acid amine;
2. aliphatic amines in which the aliphatic group has from 3 to 18 carbon atoms;
3. aromatic amines;
4. heterocyclic amines;

such as:

bis(2-hydroxyethyl) cocoamine oxide (Aromox DM16T)
coconut - acetic acid salts of n-alkyl amines (Armac C)
tallow - acetic acid salts of n-alkyl amines (Armac T)
Octylamine (Armeen 8)
hydrogenated tallowamine (Armeen HT)
tallowamine (Armeen T)
N-tallowtrimethylene diamine diacetate (Duomac T)
tertiary amines - ethylene oxide condensation products (Ethomeen C-12)
N-butylamine
N-propylamine
N-hexylamine
octylamine
dodecylamine
methoxypropylamine
di-N-propylamine
aniline
morpholine
N-ethyl morpholine
N-methyl morpholine When the developer composition of this invention is formulated to contain an amine derivative of the type described, as by addition to the developer composition in Example 1, the amine derivative is added in an amount to make up 0.0018 to 0.03 and preferably 0.003 to 0.015% by weight of the developer composition.

It will be understood that changes may be made in the details of formulation and operation without departing from the spirit of the invention, especially as defined in the following claims.

We claim:

1. A liquid developer composition for treatment to convert a latent electrostatic image to one that is ink receptive, water repellent and hydrophobic for use in the production of multiple copies by lithographic techique, the improvement which, in addition to the ink receptive, water repellent, oleophilic toner particles and a liquid aliphatic organic solvent having a resistivity in excess of $10^{10}$ ohms-cm consists essentially of the improvement wherein a resinous binder component is present which consists of a polyvinyl acetate resin and a hydrophobic colloidal silica present in combination with the polyvinyl acetate resin in the ratio of 1 part by weight of the hydrophobic colloidal silica to 1.5 to 4 parts by weight of the polyvinyl acetate.

2. A liquid developer as claimed in Claim 1 in which the materials are present in the ratio of 1 part by weight of colloidal silica to 1 to 3 parts by weight of polyvinyl acetate.

3. A liquid developer as claimed in Claim 1 in which the polyvinyl acetate is present in an amount within the range of 0.02 to 1.0% by weight.

4. A liquid developer as claimed in Claim 1 in which the polyvinyl acetate is present in an amount within the range of 0.03 to 0.7% by weight.

5. A liquid developer as claimed in Claim 1 which contains in addition a rosin or rosinate in an amount within the range of 0.02 to 0.08% by weight.

6. A liquid developer as claimed in claim 1 which contains in addition a dispersant in an amount within the range of 0.0002 to 0.02% by weight.

7. A liquid developer as claimed in claim 1 which contains in addition an oil selected from the group consisting of a paraffin oil and a mineral oil present in an amount up to 0.02% by weight.

8. A liquid developer as claimed in claim 1 which includes in addition an amine derivative selected from the group consisting of an aliphatic amine containing 3 to 18 carbon atoms, an aromatic amine, and a heterocyclic amine, in which the amine derivative is present in an amount within the range of 0.0018 to 0.03% by weight of the developer composition.

9. A liquid developer as claimed in claim 1 which includes in addition an amine derivative selected from the group consisting of an aliphatic amine containing 3 to 18 carbon atoms, an aromatic amine, and a heterocyclic amine, in which the amine derivative is present in an amount within the range of 0.003 to 0.015% by weight.

* * * * *